US007952304B2

(12) United States Patent
Zavadlsev et al.

(10) Patent No.: US 7,952,304 B2
(45) Date of Patent: May 31, 2011

(54) RADIATION SYSTEM

(76) Inventors: Alexandre A. Zavadlsev, Reutov (RU); Gary F. Bowser, Auburn, IN (US)

( * ) Notice: Subject to any disclaimer, the term of this patent is extended or adjusted under 35 U.S.C. 154(b) by 978 days.

(21) Appl. No.: 10/569,362

(22) PCT Filed: Aug. 27, 2004

(86) PCT No.: PCT/US2004/028029

§ 371 (c)(1),
(2), (4) Date: Feb. 26, 2007

(87) PCT Pub. No.: WO2005/022553

PCT Pub. Date: Mar. 10, 2005

(65) Prior Publication Data

US 2007/0158539 A1 Jul. 12, 2007

Related U.S. Application Data

(60) Provisional application No. 60/498,394, filed on Aug. 27, 2003.

(51) Int. Cl.
*H05H 9/00* (2006.01)

(52) U.S. Cl. ..... 315/505; 315/500; 250/492.3

(58) Field of Classification Search ..... 315/5.41, 315/5.42, 500, 505; 250/492.1, 492.3
See application file for complete search history.

(56) References Cited

U.S. PATENT DOCUMENTS

| | | | | |
|---|---|---|---|---|
| 4,009,444 | A * | 2/1977 | Farkas et al. | 315/5.13 |
| 4,467,284 | A * | 8/1984 | Farkas | 327/181 |
| 5,168,241 | A | 12/1992 | Hirota et al. | |
| 5,661,377 | A * | 8/1997 | Mishin et al. | 315/505 |
| 6,060,833 | A | 5/2000 | Velazco | |

* cited by examiner

*Primary Examiner* — Haissa Philogene
(74) *Attorney, Agent, or Firm* — Coursey IP Law, PC; R. Stevan Coursey

(57) ABSTRACT

Radiation systems, including apparatuses and methods, for providing multiple independent RF electron accelerators with RF power from a single RF generator. The radiation systems may be employed in radiation treatment systems for treating subject objects by irradiating them from different directions and in inspection systems for producing images of the contents of a container or other volume in multiple planes using RF electron accelerators that receive RF electromagnetic power from a single RF generator. The radiation systems include RF drive subsystems each having a 3 dB directional coupler connected between an RF generator and RF electron accelerators. Each 3 dB directional coupler divides RF electromagnetic power received from the RF generator into equal or unequal portions for delivery to respective RF electron accelerators.

6 Claims, 3 Drawing Sheets

RADIATION SYSTEM

CROSS-REFERENCE TO RELATED APPLICATION

This application claims the benefit of priority to U.S. provisional application Ser. No. 60/498,394, which is entitled "RADIATION SYSTEM" and was filed on Aug. 27, 2003.

FIELD OF THE INVENTION

The present invention relates, generally, to the field of particle accelerators and, in its exemplary embodiments, to the field of radiation systems having radio frequency (RF) electron accelerators that form a part of radiation treatment systems, inspection systems, or other systems in which the irradiation of subject objects from multiple directions or in multiple planes is beneficial.

BACKGROUND OF THE INVENTION

Radio frequency (RF) electron accelerators are sometimes employed in radiation treatment systems that are used to sterilize medical instruments and materials, pasteurize and disinfest food products, and decontaminate harmful waste. Similarly, RF electron accelerators may be employed in inspection systems for inspecting vehicles, cargo containers, packages, and travelers' luggage. Often, the RF electron accelerators used in such systems comprise linear electron accelerators having an injector for producing electrons that are injected into one or more connected accelerating sections. Electrical fields created within the accelerating sections accelerate the electrons to produce beams of electrons having appropriate energy levels. The electrical fields are, generally, created by power in the form of RF electromagnetic radiation generated by RF generators of the RF electron accelerators. Ferrite insulators are employed between the RF generators and the accelerating section(s) for uncoupling the RF generators and accelerating section(s). Alternatively, ferrite circulators may be employed in lieu of ferrite insulators to uncouple the RF generators and accelerating section(s). Unfortunately, such ferrite uncouplers cause the loss of some of the power produced by the RF generators and, hence, increase the cost of the RF electron accelerators as RF generators capable of producing more power must be utilized to account for the subsequent power losses.

The radiation treatment systems that employ such RF electron accelerators are often configured to direct the electron beams emitted from the accelerators at only one side of objects to be irradiated. In such configurations, the depth of sterilization, pasteurization, disinfestation, or decontamination into an object is, typically, small and the usage efficiency of electron beam power is low. Similarly, in inspection systems that utilize such RF electron accelerators to inspect objects, the data generated from the exposure of the objects to electron beams directed in one direction is sufficient only to produce a single view (i.e., in a single plane) of the objects. Further, in such inspection systems, the generated data is insufficient to discriminate materials of the objects.

In order to overcome the shortcomings of such radiation treatment and inspection systems, two or more RF electron accelerators might be employed in alternative systems to irradiate objects from two or more directions. However, the use of two or more RF electron accelerators would require two or more RF generators, two or more power supplies for the RF generators, and two or more control systems, thereby significantly complicating the alternative systems and increasing their cost.

Therefore, there is a need in the industry for RF electron accelerators and radiation treatment and inspection systems based thereon that irradiate objects from more than one direction and that solve these and other, related and unrelated, difficulties or shortcomings.

SUMMARY OF THE INVENTION

Briefly described, the present invention comprises apparatuses and methods for providing multiple independent RF electron accelerators with RF power from a single RF generator. More specifically, the present invention comprises apparatuses and methods for treating subject objects by irradiating them from different directions and for producing images of the contents of a container or other volume in multiple planes using RF electron accelerators that receive RF electromagnetic power from a single RF generator.

In the exemplary embodiments, the radiation systems of the present invention each comprise an RF drive subsystem having a single RF generator and a single power supply. The RF drive subsystems of the radiation systems each further comprise a 3 dB directional coupler connected between the RF generator and RF electron accelerators. The 3 dB directional coupler divides RF electromagnetic power received from the RF generator into portions for delivery to respective RF electron accelerators. Because the energy level of the pulses of electrons exiting the RF electron accelerators is dependent at least partially on the amount of RF electromagnetic power supplied to the respective accelerating sections thereof, the energy level of pulses of electrons exiting the RF electron accelerators may be made the same by configuring the 3 dB direction coupler to divide the received RF electromagnetic power for delivery to the RF electron accelerators into portions that are equal. Alternatively, the energy level of pulses of electrons exiting an RF electron accelerator may be made different than the energy level of pulses of electrons exiting another RF electron accelerator by adjusting the configuration of the 3 dB direction coupler to divide the received RF electromagnetic power for delivery to the RF electron accelerators into portions that are unequal. Further, because the 3 dB directional coupler is operable to divide RF electromagnetic power among multiple RF electron accelerators and, hence, makes the RF drive subsystem operable to supply multiple RF electron accelerators with RF electromagnetic power, the RF electron accelerators may be oriented in positions that allow the irradiation of subject objects from different directions and the generation of images of subject objects from different directions and in multiple planes.

Advantageously, the radiation systems of the present invention may be employed in radiation treatment systems, in inspection systems, or in other systems in which the irradiation of subject objects from multiple directions or in multiple planes is beneficial. For example and not limitation, in a radiation treatment system, the ability to provide multiple RF electron accelerators with RF electromagnetic power from a single RF generator enables a subject object to be irradiated from different directions better utilizing electron beam power and, thereby increasing the efficiency of the radiation system. Also, the penetration depth of irradiation into the subject object is increased over the penetration depth of irradiation into a subject object that is irradiated by a radiation system in which electrons impinge on the subject object in a single direction (i.e., a single-direction radiation system). Thus, because the penetration depth of irradiation is greater, the radiation system of the present invention may be used to treat, or irradiate, subject objects that are 2.8 times thicker than may be treated by single-direction radiation systems.

Also advantageously, the radiation systems of the present invention may be incorporated into inspection systems in which the imaging of the contents of a vehicle, cargo container, package, box, luggage, other form of container, or other volume from different directions and in multiple views or planes is beneficial. Since suck, systems often require the use of multiple RF electron accelerators that typically require their own RF generators and since the radiation systems of the present invention eliminate the need for multiple RF generators, the radiation systems of the present invention are less costly to build, operate, and maintain. Thus, the radiation systems of the present invention make possible the generation of multiple views of the contents of a vehicle, cargo container, package, box, luggage, other container, or volume in multiple planes while substantially reducing the cost of doing so.

Other objects, features, and advantages of the radiation system will become apparent upon reading and understanding the present specification when taken in conjunction with the appended drawings.

DETAILED DESCRIPTION OF THE INVENTION

Figure 1:
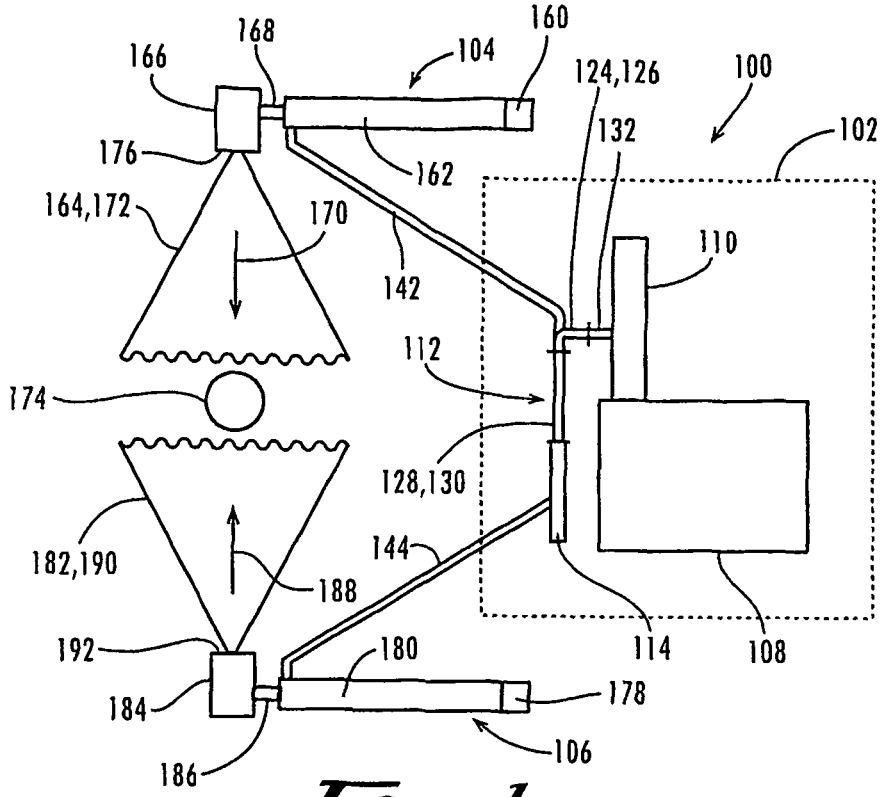
FIG. 1 displays a top, plan pictorial view of a radiation system in accordance with a first exemplary embodiment of the present invention.

Referring now to the drawings in which like numerals represent like elements or steps throughout the several views, FIG. 1 displays a top, plan pictorial view of a radiation system 100 forming part of a radiation treatment system for treating subject objects by irradiating them from different directions according to a first exemplary embodiment of the present invention. The radiation system 100 comprises a single RF drive subsystem 102, a first RF electron accelerator 104, and a second RF electron accelerator 106. The RF drive subsystem 102, importantly, includes a single power supply 108 and a single RF generator 110 connected to an output of the power supply 108 for the receipt of power therefrom. The RF drive subsystem 102 also includes a 3 dB directional coupler 112 connected between the RF generator 110 and the RF electron accelerators 104, 106 and a waveguide load 114. In a form acceptable in accordance with the first exemplary embodiment, the RF generator 110 comprises a klystron operating in the S-band frequency range and rated at 5 MW pulse (peak) power and 45 kW average power. The RF electron accelerators 104, 106, in such acceptable form, comprise 9 MeV electron accelerators that produce electron beams each having pulse currents of 0.1 A and a cumulative average power for both electron beams of 15 kW.

Figure 2:
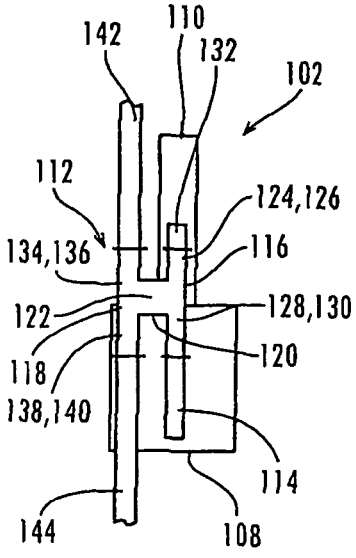
FIG. 2 displays a side, elevational pictorial view of an RF drive subsystem of the radiation system of FIG. 1.
Figure 3:
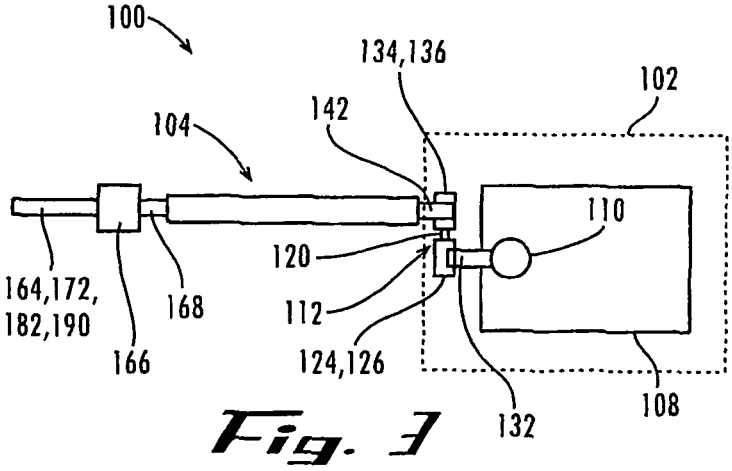
FIG. 3 displays a side, elevational pictorial view of the radiation system of FIG. 1.

The 3 dB directional coupler 112, as displayed in the side, elevational pictorial view of the RF drive subsystem of FIG. 2, comprises a first elongate waveguide 116 and a second elongate waveguide 118 extending parallel thereto. The first and second elongate waveguides 116, 118, generally, have rectangular cross-sections and share a common, narrow wall 120 therebetween. The wall 120 defines a passageway 122 (or, coupling window 122) extending therethrough that enables RF electromagnetic power to travel between the first and second waveguides 116, 118. The first waveguide 116 includes a first portion 124 that forms an input waveguide 126 of the 3 dB directional coupler 112 and a second portion 128 that forms a first output waveguide 130 of the 3 dB directional coupler 112. The input waveguide 126 of the 3 dB directional coupler 112 is connected, via a connecting waveguide 132, to an output of the RF generator 110 (see FIG. 3) for the receipt of RF electromagnetic power therefrom. The first output waveguide 130 of the 3 dB directional coupler 112 is connected to the waveguide load 114 so that any RF power reflected from first and second RF electron accelerators 104, 106 is directed to the waveguide load 114. The second waveguide 118 includes a first portion 134 that forms a second output waveguide 136 of the 3 dB directional coupler 112 and a second portion 138 that forms a third output waveguide 140 of the 3 dB directional coupler 112. The second output waveguide 136 of the 3 dB directional coupler 112 is connected to the first RF electron accelerator 104 via connecting waveguide 142 (see FIG. 1). Similarly, the third output waveguide 140 of the 3 dB directional coupler 112 is connected to the second RF electron accelerator 106 via connecting waveguide 144 (see FIG. 1).

The first RF electron accelerator 104 comprises an injector 160 and a connected accelerating section 162 that is adapted to receive electrons emitted by the injector 160. The accelerating section 162 is also connected to connecting-waveguide 142 for receipt of pulses of RF electromagnetic power from the RF drive subsystem 102 and is further adapted to accelerate the electrons received from the injector 160 via an electric field created therewithin by the received pulses of RF electromagnetic power. The accelerating section 162 may include a first portion for bunching the received electrons and a second portion for accelerating the bunched electrons. The accelerated electrons exit the accelerating section 162, generally, as a first electron beam 164 having successive pulses of accelerated electrons.

The first RF electron accelerator 104 further comprises a radiation field forming device 166 that is connected to the accelerating section 162 by connecting waveguide 168. The radiation field forming device 166 is configured to receive the first electron beam 164 from the accelerating section 162, via connecting waveguide 168, and to turn the first electron beam 164 into a first direction (i.e., illustrated, in FIG. 1, by arrow 170) such that successive pulses of the first electron beam's accelerated electrons define a first scanning plane 172 into which a subject object 174 is positioned for treatment (e.g., sterilization, pasteurization, disinfestation, or decontamination) by the first electron beam 164. The radiation field forming device 166 includes therein, according to the first exemplary embodiment, a turning device (not visible) for turning the direction of travel of the first electron beam 164 from a direction aligned with the longitudinal axis of the accelerating section 162 and into the first direction to form the first scanning plane 172. A foil-covered window 176 of the radiation field forming device 166 allows the electrons of the first electron beam 164 to exit the vacuum of the first RF electron accelerator 104 into the atmosphere.

The second RF electron accelerator 106 is substantially similar to the first RF electron accelerator 104 and comprises an injector 178 and a connected accelerating section 180 that is adapted to receive electrons emitted by the injector 178. Similarly, the accelerating section 180 is connected to a connecting waveguide 144 for receipt of pulses of RF electromagnetic power from the RF drive subsystem 102 and is further adapted to accelerate the electrons received from the injector 178 via an electric field created therewithin by the received pulses of RF electromagnetic power. The accelerating section 180 may include a first portion for bunching the received electrons and a second portion for accelerating the bunched electrons. The accelerated electrons exit the accelerating section 180, generally, as a second electron beam 182 having successive pulses of accelerated electrons.

The second RF electron accelerator 106 further comprises a radiation field forming device 184 that is connected to the accelerating section 180 by connecting waveguide 186. The radiation field forming device 184 is configured to receive the second electron beam 182 from the accelerating section 180, via connecting waveguide 186, and to turn the second electron beam 182 into a second direction (i.e., illustrated, in FIG. 1, by arrow 188) such that successive pulses of the second electron beam's accelerated electrons define a second scanning plane 190 into which the subject object 174 is also positioned for treatment (e.g., sterilization, pasteurization, disinfestation, or decontamination) by the second electron beam 182. The radiation field forming device 184 includes therein, according to the first exemplary embodiment, a turning device (not visible) for turning the direction of travel of the second electron beam 182 from a direction aligned with the longitudinal axis of the accelerating section 180 and into the second direction to form the second scanning plane 190. A foil-covered window 192 of the radiation field forming device 184 allows electrons of the second electron beam 182 to exit the vacuum of the second RF electron accelerator 106 into the atmosphere.

Generally, the radiation field forming device 166 of the first RF electron accelerator 104 and the radiation field forming device 184 of the second RF electron accelerator 106 are configured, positioned, and/or oriented such that the first direction (i.e., indicated by arrow 170) is directly opposed to the second direction (i.e., indicated by arrow 188). Also generally, the radiation field forming devices 166, 184 are configured, positioned, and/or oriented so that the first and second scanning planes 172, 190 are substantially parallel and, often, coplanar (see FIG. 3). With the radiation field forming devices 166, 184 so configured, positioned, and/or oriented, the subject object 174 is irradiated by electron beams 164, 182 striking it from two directions. However, it should be understood that the scope of the present invention includes radiation field forming devices 166, 184 that are configured, positioned, and/or oriented to emit electron beams 164, 182 therefrom in other directions than those described above and in scanning planes that are not parallel.

In operation according to a method of the first exemplary embodiment, the power supply 108 of the RF drive subsystem 102 generates pulsed power and supplies such generated power to the RF generator 110. Using the pulsed power, the RF generator 110 produces pulsed RF electromagnetic power and outputs, or delivers, such pulsed RF electromagnetic power to input waveguide 126 of the 3 dB directional coupler 112 via connecting waveguide 132. The coupling window 122 of the 3 dB directional coupler 112 divides the pulsed RF electromagnetic power into a first portion and a second portion. According to the first exemplary embodiment, the first and second portions of the pulsed RF electromagnetic power each comprise, during steady state operation of the radiation system 100, about fifty percent (50%) of the pulsed RF electromagnetic power received from the RF generator 110. It should be understood, however, that the scope of the present invention includes 3 dB directional couplers that divide the pulsed RF electromagnetic power into first and second portions that may not be equal.

The first portion of the pulsed RF electromagnetic power is output from the 3 dB directional coupler 112 through second output waveguide 136 and is delivered, via connecting waveguide 142, to the accelerating section 162 of first RF electron accelerator 104. The second portion of the pulsed RF electromagnetic power exits the 3 dB directional coupler 112 through third output waveguide 140 and is delivered, via connecting waveguide 144, to the accelerating section 180 of the second RF electron accelerator 106. Notably, during the transient start up period when the accelerating sections 162, 180 of the first and second RF electron accelerators 104, 106 are filling with RF electromagnetic power, a portion of such power is reflected back to the 3 dB directional coupler 112 via connecting waveguides 142, 144. Upon receiving the reflected RF electromagnetic power at second and third output waveguides 136, 140, the 3 dB directional coupler 112 directs such reflected power into the first output waveguide 140. The reflected RF electromagnetic power exits the first output waveguide 140 and is directed into the waveguide load 114 where it is absorbed, thereby preventing the reflected RF electromagnetic power from returning to the RF generator 110.

At appropriate time intervals, the injectors 160, 178 of the first and second RF electron accelerators 104, 106 produce and inject pulses of electrons into respective accelerating sections 162, 180. The injected electrons travel through the respective accelerating sections 162, 180 and are accelerated by respective electric fields produced therein by the pulsed RF electromagnetic power received from the RF drive subsystem 102. After being accelerated, the electrons exit respective accelerating sections 162, 180 as first and second electron beams 164, 182 each having successive pulses of accelerated electrons. The first and second electron beams 164, 182, upon exiting accelerating sections 162, 180, are respectively directed through connecting waveguides 168, 186 to respective radiation field forming devices 166, 184. Turning devices in the radiation field forming devices 166, 184, turn the first and second electron beams 164, 182 into respective first and second directions (i.e., indicated in FIG. 1 by arrows 170, 188). The first and second electron beams 164, 182 exit the radiation field forming devices 166, 184 through respective foil-covered windows 176, 192 and spread to form first and second scanning planes 172, 190 that impinge on the subject object 174 (i.e., the subject object 174 having been appropriately positioned between the radiation field forming devices 166, 184 prior to operation of the radiation system 100) that is to be treated (e.g., sterilized, pasteurized, disinfested, or decontaminated).

By virtue of the first and second electron beams 164, 182 having been turned into respective first and second directions by respective radiation field forming devices 166, 184 and the subject object 174 having been positioned appropriately therebetween, the first and second electron beams 164, 182 impinge on the subject object 174 in different directions. As a consequence, electron beam power is better utilized, thereby increasing the efficiency of the radiation system 100. Also, the penetration depth of irradiation into the subject object 174 is increased over the penetration depth of irradiation into a subject object that is irradiated by a radiation system in which electrons impinge on the subject object in a single direction (i.e., a single-direction radiation system). Thus, because the penetration depth of irradiation is greater, the radiation system 100 may be used to treat, or irradiate, subject objects that are 2.8 times thicker than may be treated by single-direction radiation systems.

Figure 4:
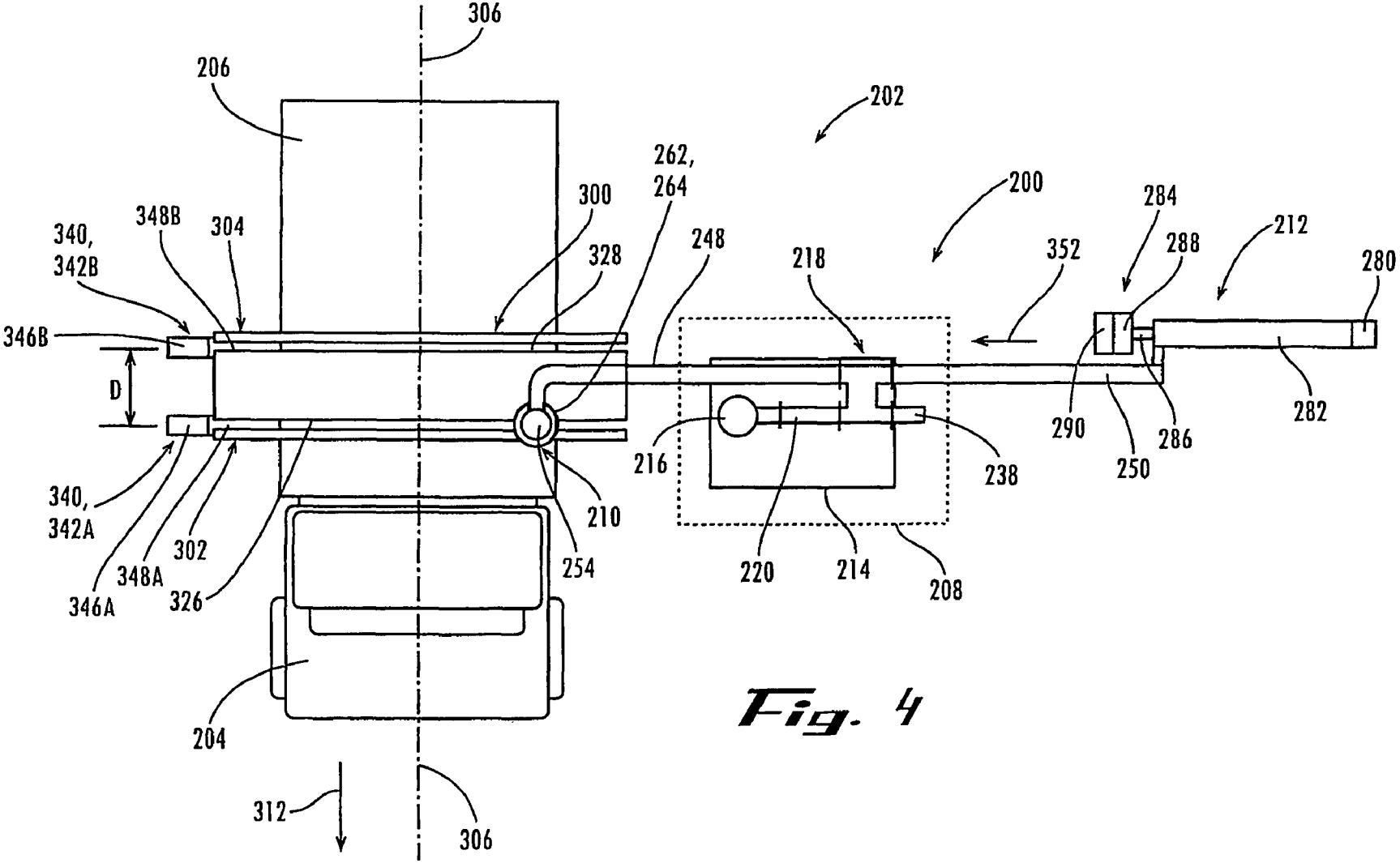
FIG. 4 displays a top, plan pictorial view of a radiation system in accordance with a second exemplary embodiment of the present invention.

FIG. 4 displays a top, plan pictorial view of a radiation system 200, in accordance with a second exemplary embodiment of the present invention, that forms a portion of a vehicle/cargo container inspection system 202 for producing images of the contents of a vehicle 204 and/or a cargo container 206 in multiple planes. The vehicle 204 and cargo container 206 may be independently inspected alone or together, as illustrated in FIG. 4, where the vehicle 204 comprises a flat bed truck and the cargo container 206 is secured thereto. Generally, the radiation system 200 and vehicle/cargo inspection system 202 of the second exemplary embodiment are configured to inspect vehicles 204 and/or cargo containers 206 having an approximately 2.5×2.5 meter frontal cross-sectional area. It should be understood, however, that the radiation system 200 and vehicle/cargo inspection system 202 may be adapted, as necessary, to produce images of vehicles 204 and/or cargo containers 204 having different frontal cross-sectional areas.

The radiation system 200 is configured to irradiate the vehicle 204 and/or cargo container 206 with radiation impinging thereon from multiple directions and in corresponding multiple planes and is substantially similar to the radiation system 100 of the first exemplary embodiment in structure and operation. The radiation system 200 comprises a single RF drive subsystem 208, a first RF electron accelerator 210, and a second RF electron accelerator 212. The RF drive subsystem 208, importantly, includes a single power supply 214 and a single RF generator 216 connected to an output of the power supply 214 for the receipt of power therefrom. The RF drive subsystem 208 also includes a 3 dB directional coupler 218 connected between the RF generator 216 and the RF electron accelerators 210, 212 and a waveguide load 220. In a form acceptable in accordance with the second exemplary embodiment, the RF generator 216 comprises a klystron operating in the S-band frequency range and rated at 5 MW pulse (peak) power and 10 kW maximal average power. The RF electron accelerators 210, 212, in such acceptable form, comprise 9 MeV electron accelerators of one meter in length having bi-periodic standing wave accelerating sections and produce electron beams each having pulse currents of 0.1 A.

Figure 5:
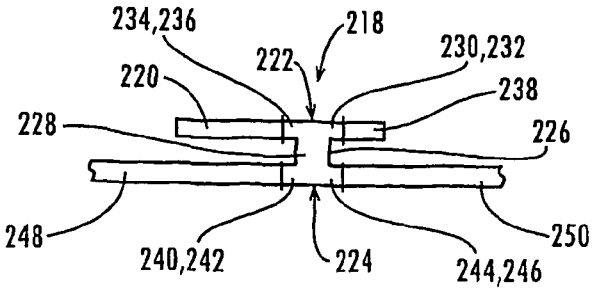
FIG. 5 displays a side, elevational pictorial view of a 3 dB directional coupler of an RF drive subsystem of the radiation system of FIG. 4.

The 3 dB directional coupler 218, as displayed in the side, elevational pictorial view thereof in FIG. 5, comprises a first elongate waveguide 222 and a second elongate waveguide 224 extending parallel thereto. The first and second elongate waveguides 222, 224, generally, have rectangular cross-sections and share a common, narrow wall 226 therebetween. The wall 226 defines a passageway 228 (or, coupling window 228) extending therethrough that enables RF electromagnetic power to travel between the first and second waveguides 222, 224. The first elongate waveguide 222 includes a first portion 230 that forms an input waveguide 232 of the 3 dB directional coupler 218 and a second portion 234 that forms a first output waveguide 236 of the 3 dB directional coupler 218. The input waveguide 232 of the 3 dB directional coupler 218 is connected, via a connecting waveguide 238, to an output of the RF generator 216 (see also FIG. 6) for the receipt of RF electromagnetic power therefrom. The first output waveguide 236 of the 3 dB directional coupler 218 is connected to the waveguide load 220 so that any RF power reflected from first and second RF electron accelerators 210, 212 is directed to the waveguide load 220. The second elongate waveguide 224 includes a first portion 240 that forms a second output waveguide 242 of the 3 dB directional coupler 218 and a second portion 244 that forms a third output waveguide 246 of the 3 dB directional coupler 218. The second output waveguide 242 of the 3 dB directional coupler 218 is connected to the first RF electron accelerator 210 via connecting waveguide 248 (see FIGS. 4 and 6). Similarly, the third output waveguide 246 of the 3 dB directional coupler 218 is connected to the second RF electron accelerator 212 via connecting waveguide 250 (see FIGS. 4 and 6).

The first RF electron accelerator 210 comprises an injector 252 and a connected accelerating section 254 that is adapted to receive electrons emitted by the injector 252. The accelerating section 254 is also connected to connecting waveguide 248 for receipt of pulses of RF electromagnetic power from the RF drive subsystem 208 and is further adapted to accelerate the electrons received from the injector 252 via an electric field created therewithin by the received pulses of RF electromagnetic power. The accelerating section 254 may include a first portion for bunching the received electrons and a second portion for accelerating the bunched electrons. The accelerated electrons exit the accelerating section 254, generally, as a first electron beam having successive pulses of accelerated electrons.

The first RF electron accelerator 210 further comprises a radiation field forming device 258 that is connected to the accelerating section 254 by connecting waveguide 260. The radiation field forming device 258 comprises a radiation conversion target 262 and a collimator 264 positioned substantially adjacent to the radiation conversion target 262. The radiation conversion target 262 is, generally, manufactured from heavy metal such as, for example and not limitation, tungsten and is adapted to convert the successive pulses of the first electron beam exiting accelerating section 254 into successive pulses of bremsstrahlung. The collimator 264, generally, includes a slot extending therethrough that is configured to receive the successive pulses of bremsstrahlung from the radiation conversion target 262 and produce therefrom narrow, substantially planar, fan-shaped bremsstrahlung 266. The radiation field forming device 258 may also comprise a turning device interposed between connecting waveguide 260 and the radiation conversion target 262 to turn the first electron beam exiting accelerating section 254 into an appropriate direction, if necessary.

The second RF electron accelerator 212 is substantially similar to the first RF electron accelerator 210 and comprises an injector 280 and a connected accelerating section 282 that is adapted to receive electrons emitted by the injector 280. Similarly, the accelerating section 282 is connected to connecting waveguide 246 for receipt of pulses of RF electromagnetic power from the RF drive subsystem 208 and is further adapted to accelerate the electrons received from the injector 280 via an electric field created therewithin by the received pulses of RF electromagnetic power. The accelerating section 282 may include a first portion for bunching the received electrons and a second portion for accelerating the bunched electrons. The accelerated electrons exit the accelerating section 282, generally, as a second electron beam having successive pulses of accelerated electrons.

The second RF electron accelerator 212 further comprises a radiation field forming device 284 that is connected to the accelerating section 282 by connecting waveguide 286. The radiation field forming device 284 comprises a radiation conversion target 288 and a collimator 290 positioned substantially adjacent to the radiation conversion target 288. The radiation conversion target 288 is, generally, manufactured from heavy metal such as, for example and not limitation, tungsten and is adapted to convert the successive pulses of the second electron beam exiting accelerating section 282 into successive pulses of bremsstrahlung. The collimator 290, generally, includes a slot extending therethrough that is configured to receive the successive pulses of bremsstrahlung from the radiation conversion target 288 and produce therefrom narrow, substantially planar, fan-shaped bremsstrahlung 292. The radiation field forming device 284 may also comprise a turning device interposed between connecting waveguide 286 and the radiation conversion target 288 to turn the second electron beam exiting accelerating section 282 into an appropriate direction, if necessary.

Figure 6:
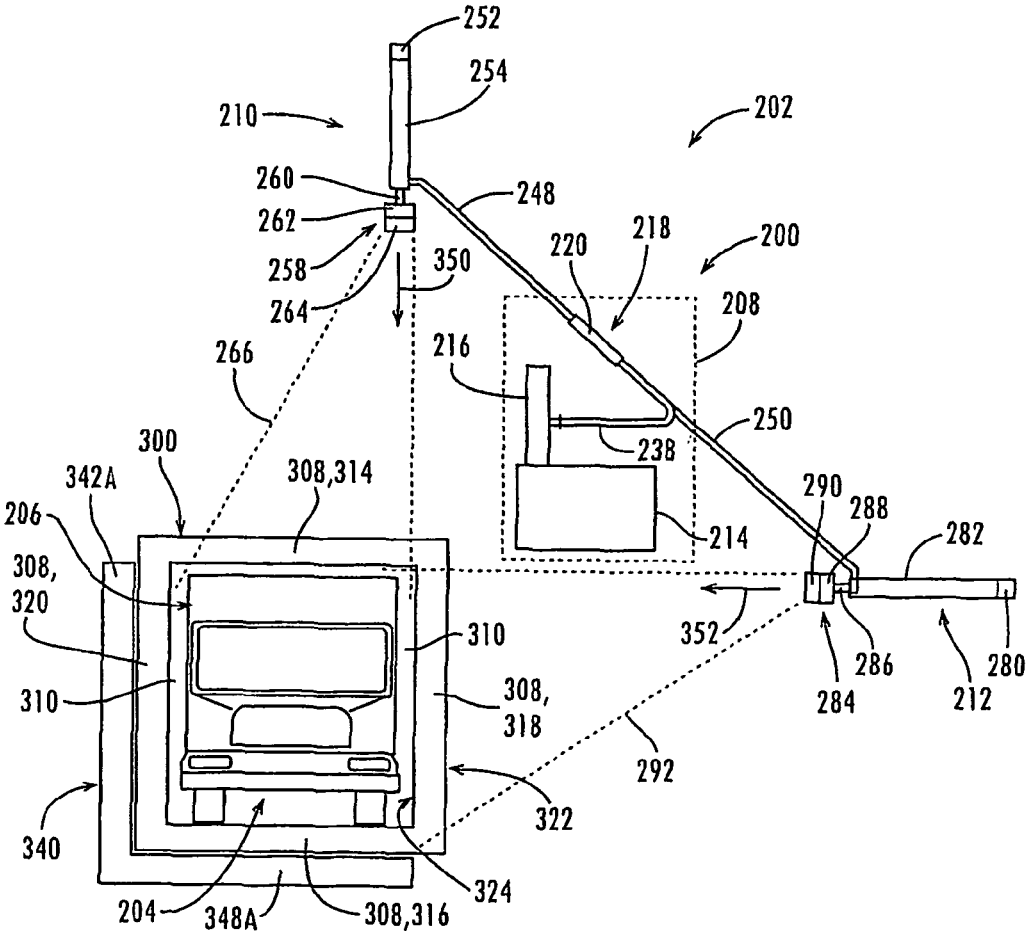
FIG. 6 displays a front, elevational pictorial view of the radiation system of FIG. 4.

As illustrated in FIGS. 4 and 6, the vehicle/cargo container inspection system 202 also comprises an elongate collimator structure 300 having a first end 302 and a second end 304 that define a longitudinal axis 306 extending therebetween. The elongate collimator structure 300 comprises a wall 308 that defines a passageway 310 extending therethrough between first and second ends 302, 304. Generally, the passageway 310 is appropriately sized to enable a vehicle 204 and attached cargo container 206 to travel through the passageway 310 in a direction (i.e., identified by arrow 312) along the longitudinal axis 306 of the collimator structure 300. The wall 308 has a top portion 314, an opposed bottom portion 316, a first side portion 318 extending between the top and bottom portions 314, 316, and a second side portion 320 opposed to the first side portion 318 and extending between the top and bottom portions 314, 316. The wall 308 has an outer surface 322 and an opposed inner surface 324 extending around passageway 310. The wall 308 defines a first slot 326 that extends between the wall's outer and inner surfaces 322, 324 and through the wall's top, bottom, first side, and second side portions 314, 316, 318, 320. The first slot 326 is substantially planar and is, generally, oriented perpendicular to the elongate collimator structure's longitudinal axis 306. The first slot 326 is configured to further collimate, during operation of the radiation system 200, the narrow, substantially planar, fan-shaped bremsstrahlung 266 exiting collimator 264 of the first RF electron accelerator 210. The wall 308 also defines a second slot 328 offset from the first slot 326 at a distance, "D", measured along the longitudinal axis 306. The second slot 328, substantially similar to the first slot 326, extends between the wall's outer and inner surfaces 322, 324 and through the wall's top, bottom, first side, and second side portions 314, 316, 318, 320. Generally also, the second slot 328 is substantially planar and is oriented perpendicular to the elongate collimator structure's longitudinal axis 306. The second slot 328, similar to the first slot 326, is configured to further collimate, during operation of the radiation system 200, the narrow, substantially planar, fan-shaped bremsstrahlung 292 exiting collimator 290 of the second RF electron accelerator 212.

The vehicle/cargo container inspection system 202 additionally comprises, as displayed in FIGS. 4 and 6, a detector 340 having first and second detector arrays 342A, 342B. The detector arrays 342A, 342B each include a plurality of individual detector elements (not visible in FIG. 4 or 6) that are operable to receive bremsstrahlung impinging thereon and to convert the received bremsstrahlung into electrical signals that relate to the intensity of the received bremsstrahlung. Each detector array 342A, 342B has a, generally, "L-shape" with a first portion 346A, 346B extending adjacent to the outer surface 322 of the elongate collimator structure's wall 308 proximate the second side portion 320 thereof and a second portion 348A, 348B extending adjacent to the outer surface 322 of the elongate collimator structure's wall 308 and elevationally beneath the bottom portion 316 thereof. The first detector array 342A is oriented relative to the first slot 326 of the elongate collimator structure's wall 308 such that the first detector array 342A is, generally, coplanar with the first slot 326. The second detector array 342B is, similar to the second slot 328 of the elongate collimator structure's wall 308 relative to the first slot 326 thereof, offset from the first detector array 342A at a distance, "D", measured along the longitudinal axis 306. The second detector array 342B is oriented relative to the second slot 328 of the elongate collimator structure's wall 308 such that the second detector array 342B is, generally, coplanar with the second slot 328.

The first RF electron accelerator 210, in accordance with the second exemplary embodiment of the present invention, is located at an appropriate position elevationally offset from and above the top portion 314 of the elongate collimator structure's wall 308 (see FIG. 6). The appropriate position of the first RF electron accelerator 210 is selected such that, during operation of the radiation system 200, the narrow, substantially planar, fan-shaped bremsstrahlung 266 exiting collimator 264 passes through the first slot 326 of the elongate collimator structure's wall 308, through the vehicle 204 and cargo container 206 (and, hence, through the contents thereof) in a, generally, downward direction (i.e., indicated in FIG. 6 by arrow 350), and impinges on the first and second portions 346A, 348A of the first detector array 342A. Thus, the planes of the bremsstrahlung 266, first slot 326 of the elongate collimator structure's wall 308, and first detector array 342A are, substantially, coplanar and perpendicular to the direction of travel of the vehicle 204 and cargo container 206.

The second RF electron accelerator 212, according to the second exemplary embodiment, is located at an appropriate position laterally offset from the first side portion 318 of the elongate collimator structure's wall 308 (see FIGS. 4 and 6). The appropriate position of the second RF electron accelerator 212 is selected such that, during operation of the radiation system 200, the narrow, substantially planar, fan-shaped bremsstrahlung 292 exiting collimator 290 passes through the second slot 328 of the elongate collimator structure's wall 308, through the vehicle 204 and cargo container 206 (and, hence, through the contents thereof) in a, generally, lateral direction (i.e., indicated in FIG. 6 by arrow 352), and impinges on the first and second portions 346B, 348B of the second detector array 342B. Thus, the planes of the bremsstrahlung 292, second slot 328 of the elongate collimator structure's wall 308, and second detector array 342B are, substantially, coplanar and perpendicular to the direction of travel of the vehicle 204 and cargo container 206.

In operation according to a method of the first exemplary embodiment, the power supply 214 of the RF drive subsystem 208 generates pulsed power and supplies such generated power to the RF generator 216. Using the pulsed power, the RF generator 216 produces pulsed RF electromagnetic power and outputs, or delivers, such pulsed RF electromagnetic power to input waveguide 232 of the 3 dB directional coupler 218 via connecting waveguide 238. The coupling window 228 of the 3 dB directional coupler 218 divides the pulsed RF electromagnetic power into a first portion and a second portion. According to the second exemplary embodiment, the first and second portions of the pulsed RF electromagnetic power each comprise, during steady state operation of the radiation system 200, about fifty percent (50%) of the pulsed RF electromagnetic power received from the RF generator 216. The first portion of the pulsed RF electromagnetic power is output from the 3 dB directional coupler 218 through second output waveguide 242 and is delivered, via connecting waveguide 248, to the accelerating section 254 of first RF electron accelerator 210. The second portion of the pulsed RF electromagnetic power exits the 3 dB directional coupler 218 through third output waveguide 246 and is delivered, via connecting waveguide 250, to the accelerating section 282 of the second RF electron accelerator 212. Notably, during the transient start up period when the accelerating sections 254, 282 of the first and second RF electron accelerators 210, 212 are filling with RF electromagnetic power, a portion of such power is reflected back to the 3 dB directional coupler 218 via connecting waveguides 248, 250. Upon receiving the reflected RF electromagnetic power at second and third output waveguides 242, 246, the 3 dB directional coupler 218 directs such reflected power into the first output waveguide 236. The reflected RF electromagnetic power exits the first output waveguide 236 and is directed into the waveguide load 220 where it is absorbed, thereby preventing the reflected RF electromagnetic power from returning to the RF generator 216.

At appropriate time intervals, the injectors 252, 280 of the first and second RF electron accelerators 210, 212 produce and inject pulses of electrons into respective accelerating sections 254, 282. The injected electrons travel through the respective accelerating sections 254, 282 and are accelerated by respective electric fields produced therein by the pulsed RF electromagnetic power received from the RF drive subsystem 208. After being accelerated, the electrons exit respective accelerating sections 254, 282 as first and second electron beams each having successive pulses of accelerated electrons. The first and second electron beams, upon exiting accelerating sections 254, 282, are respectively directed through connecting waveguides 260, 286 to respective radiation field forming devices 258, 284. Upon entering the radiation field forming devices 258, 284, the first and second beams impinge on respective radiation conversion targets 262, 288 that convert the successive pulses of the first and second electron beams exiting respective accelerating sections 254, 282 into successive pulses of bremsstrahlung. Then, the successive pulses of bremsstrahlung pass through the slots of respective Collimators 264, 290 with narrow, substantially planar, fan-shaped bremsstrahlung 266, 292 being produced therefrom and output from respective radiation field forming devices 258, 284.

The substantially planar, fan-shaped bremsstrahlung 266 emitted from radiation field forming device 258 travels in a, generally, downward direction (i.e., indicated by arrow 350) toward the top portion 314 of the elongate collimator structure's wall 308 and the first slot 326 thereof. The portion of the first slot 326 in the top portion 314 of the elongate collimator structure's wall 308 collimates the bremsstrahlung 266 so that a portion of the bremsstrahlung 266 is directed through the first slot 326 and through the vehicle 204 and cargo container 206 (and, hence, through the contents thereof. After passing through the vehicle 204 and cargo container 206, the portions of the first slot 326 in the bottom and second side portions 316, 320 of the elongate collimator structure's wall 308 collimate the bremsstrahlung 266 so that a portion of the bremsstrahlung 266 is directed through the first slot 326 for a second time. The portion of the bremsstrahlung 266 that passes through the portions of the first slot 326 in the bottom and second side portions 316, 320 of the elongate collimator structure's wall 308 impinges on the first and second portions 346A, 348A of the first detector array 342A. Detector elements in the first and second portions 346A, 348A of the first detector array 342A detect the intensity of the bremsstrahlung 266 impinging thereon and produce data in the form of electrical signals that are communicated to a signal processing portion of the vehicle/cargo container inspection system 202.

In a similar manner, the substantially planar, fan-shaped bremsstrahlung 292 emitted from radiation field forming device 284 travels in a, generally, horizontal or lateral direction (i.e., indicated by arrow 352) toward the first side portion 318 of the elongate collimator structure's wall 308 and the second slot 328 thereof. The portion of the second slot 328 in the first side portion 318 of the elongate collimator structure's wall 308 collimates the bremsstrahlung 292 so that, a portion of the bremsstrahlung 292 is directed through the second slot 328 and through the vehicle 204 and cargo container 206 (and, hence, through the contents thereof. After passing through the vehicle 204 and cargo container 206, the portions of the second slot 328 in the bottom and second side portions 316, 320 of the elongate collimator structure's wall 308 collimate the bremsstrahlung 292 so that a portion of the bremsstrahlung 292 is directed through the second slot 328 for a second time. The portion of the bremsstrahlung 292 that passes through the portions of the second slot 328 in the bottom and second side portions 316, 320 of the elongate collimator structure's wall 308 impinges on the first and second portions 346B, 348B of the second detector array 342B. Detector elements in the first and second portions 346B, 348B of the second detector array 342B detect the intensity of the bremsstrahlung 292 impinging thereon and produce data in the form of electrical signals that are communicated to a signal processing portion (not shown) of the vehicle/cargo container inspection system 202.

The signal processing portion of the vehicle/cargo container inspection system 202 receives the data (e.g., electrical signals) from the first and second detector arrays 342A, 342B and generates therefrom images of the contents of the vehicle 204 and cargo container 206. Because the data produced by the first detector array 342A corresponds to the bremsstrahlung 266 emitted from the first RF electron accelerator 210 in a, generally, downward direction (i.e., indicated by arrow 350), a first image of the contents of the vehicle 204 and cargo container 206 is generated that comprises a first view looking at a slice of the vehicle 204 and cargo container 206 downward and side-to-side. Since the data produced by the second detector array 342B corresponds to the bremsstrahlung 292 emitted from the second RF electron accelerator 212 in a, generally, horizontal or lateral direction (i.e., indicated by arrow 352), a second image of the contents of the vehicle 204 and cargo container 206 is generated that comprises a second view looking at a slice of the vehicle 204 and cargo container 206 from the side and top-to-bottom. Thus, the vehicle/cargo container inspection system 202 of the second exemplary embodiment produces views of the contents of the vehicle 204 and cargo container 206 from multiple directions and in multiple planes.

By moving the vehicle 204 and cargo container 206 at an appropriate speed along the longitudinal axis 306 of the elongate collimator structure 300 in the direction indicated by arrow 312 and by aggregating and ordering the first views of the contents of the vehicle 204 and cargo container 206 generated by data collected by the detector arrays 342A, 342B at successive slices through the vehicle 204 and cargo container 206, the vehicle/cargo container inspection system 202 generates an image, or view, of the contents of the vehicle 204 and cargo container 206 in a first plane looking downward at the tops of the vehicle 204 and cargo container 206 and extending the entire length of the vehicle 204 and cargo container 206. Similarly, by aggregating and ordering the second views of the contents of the vehicle 204 and cargo container 206 generated by data collected by the detector arrays 342A, 342B at successive slices through the vehicle 204 and cargo container 206 taken while moving the vehicle 204 and cargo container 206, the vehicle/cargo container inspection system 202 generates an image, or view, of the contents of the vehicle 204 and cargo container 206 in a second plane looking at the sides of the vehicle 204 and cargo container 206 and extending the entire length of the vehicle 204 and cargo container 206.

Importantly, the vehicle/cargo container inspection system 202 generates multiple views of the contents of a vehicle 204 and cargo container 206 using a radiation system 200 including an RF drive subsystem 208 that utilizes only a single power supply 214 and a single RF generator 216 to provide RF electromagnetic power for two independent RF electron accelerators 210, 212. Through the inventive use of only one power supply 214 and one RF generator 216 (and, hence, one control system therefor), the radiation system 200 of the second exemplary embodiment eliminates the need for two power supplies and two RF generators that would, ordinarily, be required to provide RF electromagnetic power for two independent RF electron accelerators. As a consequence, the radiation system 200 of the second exemplary embodiment of the present invention is substantially less costly to build, operate, and maintain than standard radiation systems have multiple RF electron accelerators. Thus, the radiation system 200 makes possible the generation of multiple views of the contents of a vehicle 204 and cargo container 206 in multiple planes while substantially reducing the cost of doing so.

It should be understood that while the present invention has been described in the second exemplary embodiment in connection with systems for the inspection of vehicles and cargo containers, that the scope of the present invention includes systems for the inspection of containers, packages, boxes, bags, luggage, or other forms of containers.

Whereas this invention has been described in detail with particular reference to exemplary embodiments and variations thereof, it is understood that other variations and modifications can be effected within the scope and spirit of the invention, as described herein before and as defined in the appended claims.

What is claimed is:

1. A radiation system, comprising:

a radio frequency power generator adapted to generate radio frequency electromagnetic power;

a first radio frequency electron accelerator adapted to receive radio frequency electromagnetic power and to accelerate a first pulsed beam of electrons;

a second radio frequency electron accelerator adapted to receive radio frequency electromagnetic power and to accelerate a second pulsed beam of electrons; and, a 3 dB directional coupler connected to said radio frequency power generator for receiving radio frequency electromagnetic power therefrom, said 3 dB directional coupler being adapted to divide received radio frequency electromagnetic power into a first portion for delivery to said first radio frequency electron accelerator and a second portion for delivery to said second radio frequency electron accelerator.

2. The radiation system of claim 1, wherein said 3 dB directional coupler is connected between said radio frequency power generator and said first radio frequency electron accelerator and said second radio frequency electron accelerator.

3. The radiation system of claim 1, wherein said first portion of received radio frequency electromagnetic power and said second portion of received radio frequency electromagnetic power are equal.

4. The radiation system of claim 1, wherein said first radio frequency electron accelerator is oriented to emit said first pulsed beam of electrons in a first direction and said second radio frequency electron accelerator is oriented to emit said second pulsed beam of electrons in a second direction, and wherein said first direction is substantially opposed to said second direction.

5. The radiation system of claim 1, wherein said first radio frequency accelerator includes a conversion target adapted to convert said first pulsed beam of electrons into a pulsed beam of bremsstrahlung in a plane.

6. The radiation system of claim 5, wherein said plane of said pulsed beam of bremsstrahlung is substantially perpendicular to the direction of travel of a subject object.

* * * * *